United States Patent [19]

Karr

[11] 4,303,462

[45] Dec. 1, 1981

[54] ROLL WRAPPER HEADER APPARATUS

[75] Inventor: Gerald W. Karr, South Beloit, Ill.

[73] Assignee: Beloit Corporation, Beloit, Wis.

[21] Appl. No.: 92,735

[22] Filed: Nov. 9, 1979

[51] Int. Cl.[3] ..... B32B 31/00

[52] U.S. Cl. ..... 156/538; 53/137; 156/580; 156/581

[58] Field of Search ..... 156/538, 580, 581; 206/413–416; 53/137

[56] References Cited

U.S. PATENT DOCUMENTS

| | | | |
|---|---|---|---|
| 1,580,361 | 4/1926 | Anson | 53/137 X |
| 1,817,017 | 8/1931 | Norton | 53/137 X |
| 1,840,222 | 1/1932 | Brown | 53/137 X |
| 2,144,686 | 1/1939 | Owens | 53/137 X |
| 3,400,247 | 10/1968 | Derr | 156/538 |

*Primary Examiner*—David A. Simmons

*Attorney, Agent, or Firm*—Hill, Van Santen, Steadman, Chiara & Simpson

[57] ABSTRACT

Apparatus for applying outside heads in the form of paperboard disks to the ends of wrapped paper rolls has platens provided with means, i.e., recesses, for accommodating protruding roll core ends in a manner to avoid interference of such protruding core ends with efficient, uniform application of the heads to the ends of the wrapped paper rolls. Means cooperate with the core end accommodating means for holding the heads on the platens until the heads have been applied to the roll ends. Such holding means desirably comprise an array of radiating channels dead ended adjacent to the core end accommodating means recess on each platen and communicating through ports adjacent the dead ends with a suction device, i.e., blower fan.

4 Claims, 5 Drawing Figures

ROLL WRAPPER HEADER APPARATUS

This invention relates to improvements in roll wrapper header apparatus and is more particularly concerned with the header platen structure.

U.S. Pat. No. 3,408,247 exemplifies the type of header apparatus to which the present invention is directed. Such apparatus comprises a pair of opposed cooperatively related platens which are adapted to support outside heads to be applied to the ends of wrapped paper rolls to maintain and protect the crimped ends of the wrapper on the ends of the rolls. The heads comprise paperboard disks calculated as to diameter to fit the particular diameter of rolls to which to be applied. Glue is applied to the faces of the headers which engage the wrapped roll ends. Each of the platens has suction means associated therewith for drawing sufficient vacuum through the head carrying faces of the platens to hold the paperboard heads in place while the platens are maneuvered from a spread apart clearance relation into header applying and clamping engagement with the ends of a wrapped roll located for this purpose between the platens which are mounted on movable carriages for reciprocation into and out of the outside head applying and clamping position.

While apparatus of the type disclosed in the aforesaid patent has proved quite successful, a problem is frequently encountered where the roll core may protrude from one or more ends of a roll to which outside heads are to be applied. Such protruding core ends interfere with proper uniform compression of the affected platen against the roll end. Such roll core protrusion may be only as little as ¼ inch, but that is enough to interfere with efficient outside head application by the affected platen.

It is to the alleviation of the mentioned problem that the present invention is directed.

It is therefore an important object of the present invention to provide in roll wrapper header apparatus new and improved platen means for efficiently applying the heads to the ends of wrapped rolls even though there may be some endwise protrusion of the cores on which the rolls have been wound.

The present invention provides apparatus for applying outside heads to the ends of wrapped paper rolls and comprising opposed spaced head applying platens having means for retaining heads on head carrying faces of the platens. Each of the platens has relief means e.g., a recess in its head carrying and pressure applying face for clearance accommodation of roll cores that may protrude beyond the ends of wrapped roll of paper. Thereby interference with efficient application of the heads to the ends of the rolls is avoided. In a desirable arrangement, the head carrying faces of the platens have an efficient suction or vacuum retaining arrangement which is uneffected by the protruding roll core end accommodating relief recesses in the platens.

Other objects, features and advantages of the invention will be readily apparent from the following description of a certain representative embodiment thereof, taken in conjunction with the accompanying drawings although variations and modifications may be effected without departing from the spirit and scope of the novel concepts embodied in the disclosure and in which.

Figure 1:
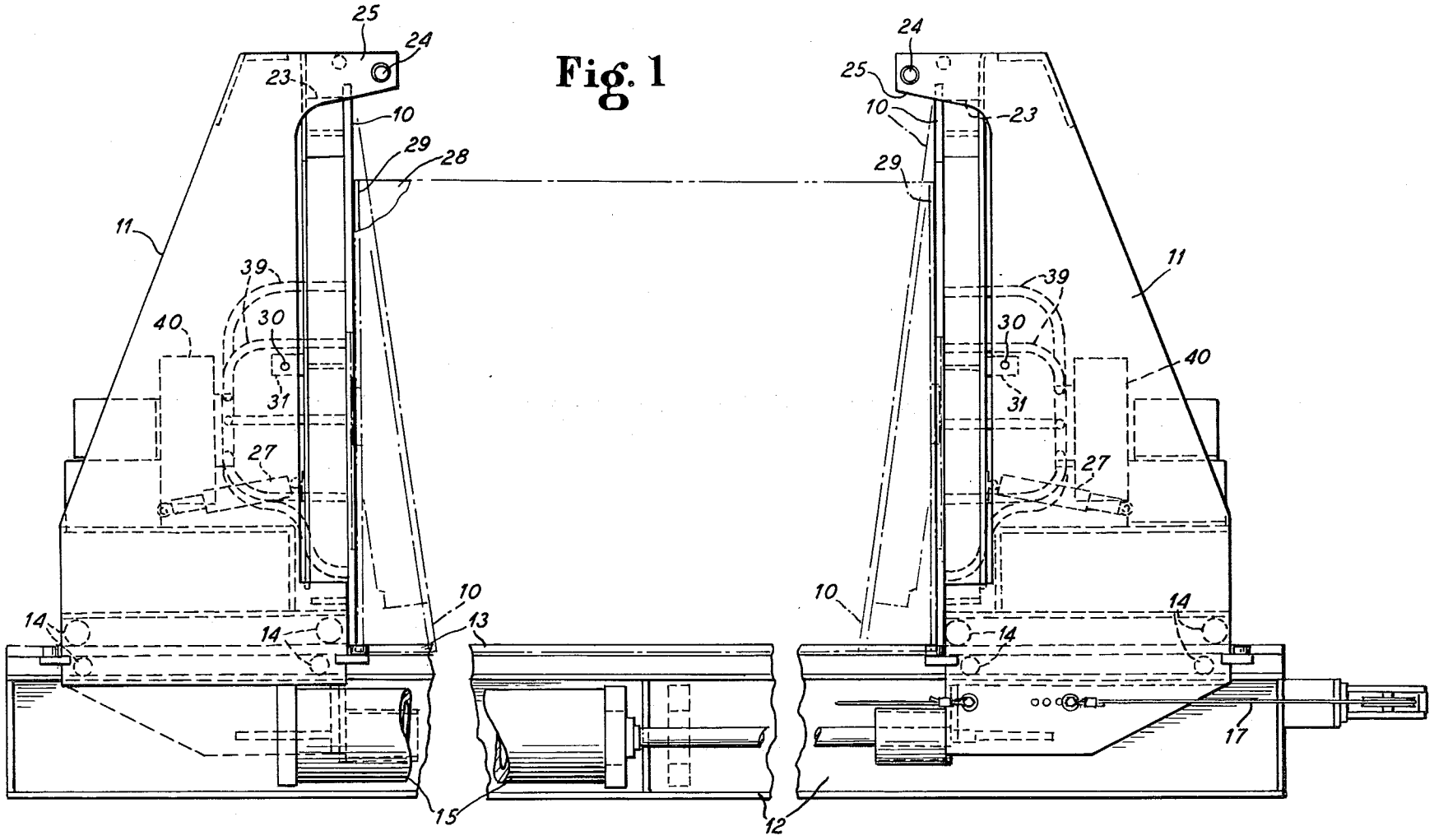
FIG. 1 is a fragmental side elevational view of roll wrapper header apparatus embodying the invention.
Figure 2:
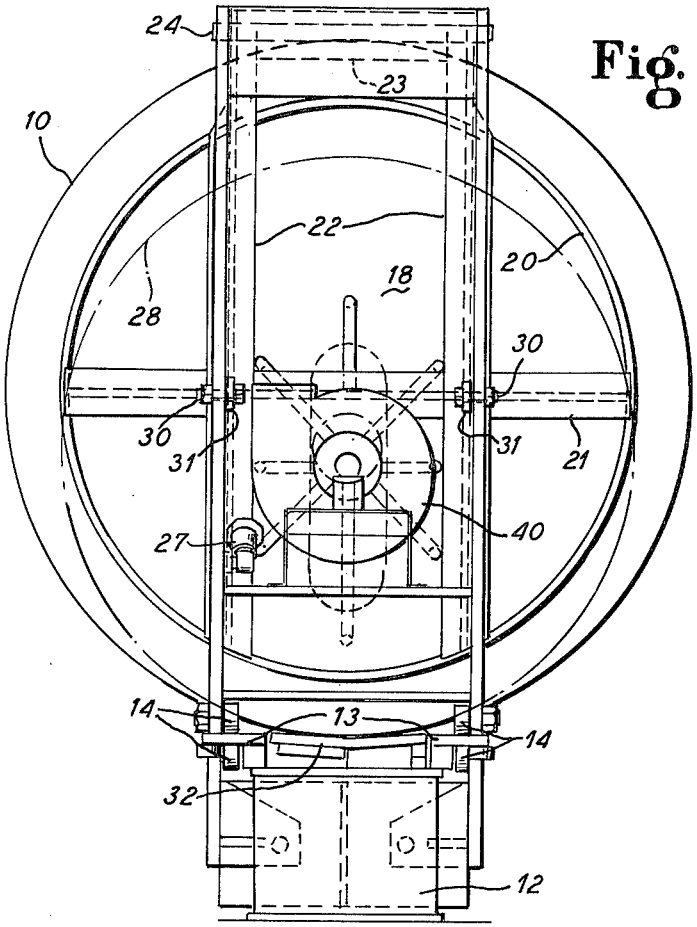
FIG. 2 is an end elevational view looking toward the left end of FIG. 1.

A roll wrapper header apparatus embodying the invention, as illustrated in FIGS. 1 and 2, includes cooperatively opposed spaced header platen 10 operatively carried by respective upright carriages 11 comprising suitable frames reciprocatingly mounted on an elongate beam base 12 provided with tracks or ways 13 on which the carriages 11 are supported in anti-friction running relation as by means of rollers 14 carried by the carriages. Means for reciprocating the carriages 11 toward and away from one another comprise one or more fluid operated rectilinear actuators 15 and cross tie cable means 17.

Figure 3:
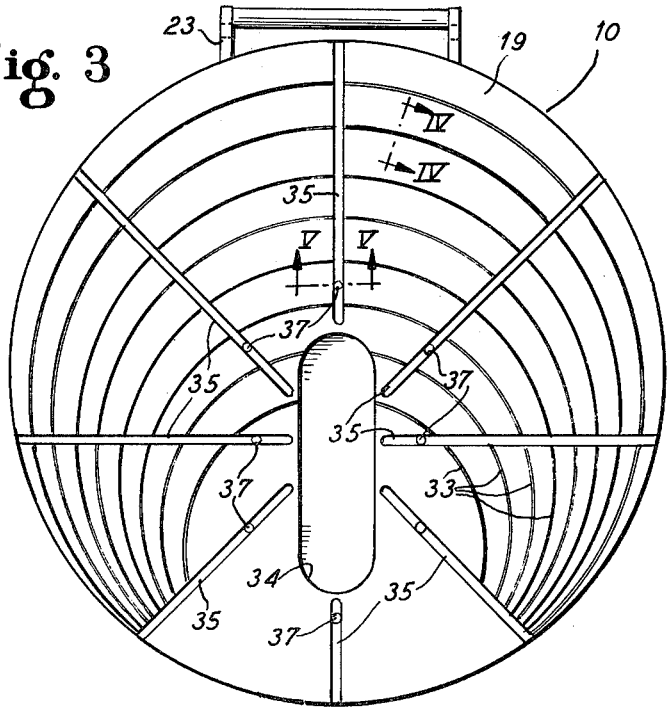
FIG. 3 is a face plan view of one of the platens.

Both of the platens 10 may be substantially identical, each comprising a preferably cylindrical disk plate having a back face 18 (FIG. 2) and a front or head carrying and pressure face 19 (FIG. 3). For reinforcement, each of the platens 10 may be provided on its back face 18 with a concentric reinforcing ring 20 and a horizontal diametric T-shaped cross bar 21. Also on the back face 18 is mounted platen suspension means comprising a vertical frame formed of preferably substantially T-shaped reinforcing bars and having upper end portions carrying a horizontal suspension bracket 23 projecting in overhanging relation to the front face 19 of the associated platen 10 and connected by means of a connecting rod and pivot 24 to and between spaced supporting and suspension arms 25 on the upper end of the associated carriage 11. Through this arrangement, the respective platens 10 are adapted to swing forwardly at their lower side as indicated in dash outline in FIG. 1 under the bias of respective pneumatic or spring operated rectilinear dash-pot devices 27. When pressing the platens 10 against the ends of a wrapped paper roll 28 to apply a head 29 thereto, the platens are caused to swing back to a vertical position from the outwardly tilted position and are backed-up by the respective carriage 11 for applying clamping pressure against the heads 29 as actuated by the actuating system including the actuator or actuators 15. For certain purposes such as when maximum length rolls are to be supplied with outside heads 29, it may be desired to restrain the platens 10 in the vertical pressure applying position, and for this purpose means comprising locking pins 30 are secured through and between latching ears 31 projecting rearwardly from the frame bars 22, and the adjacent portions of the frame of the associated carriage 11.

Figure 4:
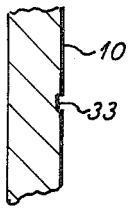
FIG. 4 is an enlarged fragmentary sectional detail view taken substantially along the line IV—IV of FIG. 3.

In a typical installation, the platens 10 may be about 60 inches in diameter and adapted for accommodating a wide range of diameters of paper rolls to receive outside heads 29. Each paper roll 28 is supported on a cradle beam or bar 32 extending lengthwise on the base 12 in alignment with the lowermost perimeter points of the platens 10, as best seen in FIG. 2. This permits rolls of a wide range of diameters to be headed in the apparatus. For substantially accurate orientation of heads of appropriate diameter for rolls of respectively different diameters, the applying faces 19 of the platens 10 are desirably provided with indexing means comprising circular indexing markings 33 all tangent with the low point on the perimeter of the associated platen, as best visualized in FIG. 3. The indexing marks or lines 33 may be provided in the form of shallow grooves as shown in the enlarged illustration in FIG. 4.

Although the roll cores may not always protrude from the ends of the paper rolls 28, such protrusion occurs with sufficient frequency to interfere with uniform, efficient application of the head panels 29 to the wrapped roll ends. According to the present invention, this problem is alleviated by providing the head applying faces 19 of the platens 10 with respective protruding core accommodating relief means desirably in the form of suitable designed recesses 34 (FIG. 3). Each of the recesses 34 is preferably of a depth just sufficient to accommodate maximum protrusion such as about ¼ inch of the roll cores, and of suitable width to avoid straining the central portion of the applied head 29, while nevertheless permitting the platen to press the maximum area of the head against the roll end. Further, the recess 34 is centered on the vertical diameter of the platen 10 and is of a vertical length to accommodate the position of a protruding core of every diametrical size of roll to be headed. For example, the vertical length and disposition of the recess 34 is such as to accommodate rolls varying in diameter from about 14 inch radius to about 30 inch radius, where the platen 10 is of 60 inch diameter. In a typical practical construction, in such a platen, which may be formed from material of about ¾ inch thickness, the relief recess 34 may be about 5/16 inch in depth, about 7 inches wide, and about 23 inches in length, with its upper and lower ends arcuate and adequately spaced at the lower end below the point at which the minimum diameter roll core may protrude into the recess and suitably spaced at the upper end above the point at which the maximum diameter roll core may protrude into the recess. In other words, the recess 34 is of such design that it will cover the area in the platen face 19 where all cores would normally contact the face and therefore the remainder of the platen face can efficiently contact and press the head 29 against the roll end.

Figure 5:
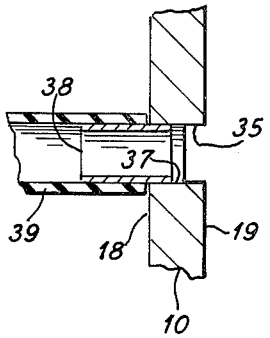
FIG. 5 is an enlarged fragmentary sectional detail view taken substantially along the line V—V of FIG. 3.

In the operation of the apparatus, the heads 29 are provided on their roll and engaging faces with suitable adhesive, as is conventional, and the heads then received on the respective header faces 19 in properly indexed position to be applied to the roll ends. For retaining the fairly thin disk paperboard heads 29 in place on the platen faces 19, suitable retaining means are provided, desirably in the form of means for effecting suction vacuum to draw the back faces of the heads 29 against the faces 19 of the platens. For this purpose, each of the platen faces 19 is provided with a generally radiating array of grooves 35 which dead end adjacently spaced from the recess 34 and extend to the perimeter of the platen 10. Adjacent to the dead end of each of the grooves 35 is a port 37 (FIG. 5) within which is secured a nipple 38 extending from the back face 18 of the platen 10 and to which is secured a respective flexible air hose 39 leading to a suction device 40 such as an air blower or fan carried by the associated carriage 11. A desirable arrangement comprises eight of the grooves 35 with the terminal, dead ends of the grooves so located in a symmetrical pattern about the recess 34, as shown to assure that a substantial number of the suction ports 37 will be covered by even the smallest diameter head 29. In the example shown, it will be noted that five of the eight ports 37 will be covered by the smallest diameter head fitting within the smallest indexing marking 33. By sizing the individual air inlet ports 37 so that their total area and friction loss will not quite satisfy the associated suction fan 40, it is not necessary that all of the ports 37 be covered by the head disk 29. For example where the head disk covers only five of the eight inlet holes, the three uncovered holes or ports cannot satisfy the fan and therefore the five covered ports will draw air through their associated grooves 35 thereby creating a holding force fairly uniformly on the back face of the retained head disk by virtue of the vacuum and high air velocity drawn through the closed channel portions of the grooves 35 and the ports 37. In a practical arrangement where the platens 10 are about 60 inches in diameter, the grooves 35 may be about 5/16 inch deep and ¾ inch wide, and the ports 37, ¾ inch in diameter. Operation and capacity of the suction fans 40 is desirably calculated to maintain the head disks in place on the platens 10 with sufficient force to avoid displacement of the head disks until the head disks have been applied by the platens to the wrapped roll ends and the adhesive carried by the head disks have bonded the disks to the crimped wrapper ends. Thereupon the fan 40 is discontinued so that the head disk is instantaneously released from the platen 10. To accelerate setting of the adhesive heating means (not shown) may be carried by the platens, and it will be understood that the pressure applied by the platens to the head disks against the roll ends will be maintained for a sufficient time interval to assure setting of the adhesive sufficiently to maintain a secure bond of the head disk in each instance to the end wrap of the paper roll. It will be understood, of course, that after outside heading of the successive paper rolls, they are discharged from the supporting cradle 32 of the header apparatus and transported to any desired further processing station and then to storage or point of use.

It will be understood that variations and modifications may be effected without departing from the spirit and scope of the novel concepts of this invention.

I claim as my invention:

1. In apparatus for applying outside heads in the form of paperboard disks to the ends of wrapped paper rolls, and wherein the apparatus has opposed spaced head-applying platens each of which has a head disk carrying and pressure face, the improvement comprising:

each of said platens having a respective recess in its pressure face for accommodating protuding roll core ends in a manner to avoid interference of such protruding core ends with efficient, uniform application of said heads to the ends of the wrapped paper rolls;

and an air suction system in each of said faces for holding the heads on the platens until the heads have been applied to the roll ends;

said system comprising an array of grooves in each of said faces and which grooves dead end adjacently spaced from the recess and extend in generally radiating pattern toward the perimeters of said faces, and suction ports leading from said grooves adjacent to their dead ends and connected to a suction device;

said suction device having respective ducts leading from said suction ports.

2. Apparatus according to claim 1, wherein said recesses are elongated in vertical dimension to accommodate protruding core ends of a substantial range of diameters of rolls to which heads are to be applied, with the upper ends of the recesses adjacent to the centers of said faces to accommodate protruding core ends of maximum diameter rolls and the recesses extending downwardly a substantial length below said center for accommodating rolls of minimum diameter at the lower ends of the recesses.

3. A platen for applying an outside head in the form of a paperboard disk to the end of a wrapped paper roll in a header apparatus, said platen comprising:

a head disk carrying and pressure face having a recess therein for accommodating a protruding roll core end in a manner to avoid interference of such protruding core end with efficient, uniform application of a head disk to the end of the wrapped roll;

and an air suction system in said face for holding the head disk on the platen until the head disk has been applied to the roll end;

said system comprising an array of grooves in said face and which grooves dead end adjacently spaced from said recess and extend in generally radiating pattern toward the perimeter of said face, and suction ports leading from said grooves adjacent to said dead ends and connected to a suction device;

said suction device having respective ducts leading from said suction ports.

4. Apparatus according to claim 3, wherein said recess is elongated in vertical dimension to accommodate protruding core ends on a substantial range of diameters of rolls to which heads are to be applied, with the upper end of the recess substantially aligned with the center of said face to accommodate projecting core ends of maximum diameter rolls and the recess extending downwardly a substantial length below said center for accommodating projecting core ends of rolls of minimum diameter at the lower end of the recess.

* * * * *